US005894103A

United States Patent [19]

Shann

[11] Patent Number: 5,894,103

[45] Date of Patent: Apr. 13, 1999

[54] DETONATOR CIRCUIT

[75] Inventor: Peter Christian Shann, York, United Kingdom

[73] Assignee: Hatorex AG, Geneva, Switzerland

[21] Appl. No.: 08/836,220

[22] PCT Filed: Nov. 14, 1995

[86] PCT No.: PCT/GB95/02666

§ 371 Date: May 7, 1997

§ 102(e) Date: May 7, 1997

[87] PCT Pub. No.: WO96/16311

PCT Pub. Date: May 30, 1996

[30] Foreign Application Priority Data

Nov. 18, 1994 [GB] United Kingdom ..... 9423313

[51] Int. Cl.[6] ..... F24C 15/40

[52] U.S. Cl. ..... 102/215; 102/217

[58] Field of Search ..... 102/206, 215, 102/217, 218

[56] References Cited

U.S. PATENT DOCUMENTS

| | | | |
|---|---|---|---|
| 4,674,047 | 6/1987 | Tyler et al. | 102/200 |
| 4,986,183 | 1/1991 | Jacob et al. | 102/200 |
| 5,014,622 | 5/1991 | Jullian | 102/312 |
| 5,038,682 | 8/1991 | Marsden | 102/220 |
| 5,117,756 | 6/1992 | Goffin, II | 102/217 |
| 5,214,236 | 5/1993 | Murphy et al. | 102/217 |
| 5,295,438 | 3/1994 | Hill et al. | 102/217 |

FOREIGN PATENT DOCUMENTS

| | | | |
|---|---|---|---|
| 429229 | 5/1991 | European Pat. Off. | 102/206 |
| 586685 A1 | 3/1994 | European Pat. Off. . | |
| 604694 A1 | 7/1994 | European Pat. Off. | 102/206 |
| 2093286 | 8/1982 | United Kingdom | 102/217 |
| 2121089 | 12/1985 | United Kingdom | 102/217 |

OTHER PUBLICATIONS

Definition for "portable"; Webster's II New Riverside Dictionary, p. 916, 1994.

*Primary Examiner*—Charles T. Jordan
*Assistant Examiner*—Christopher K. Montgomery
*Attorney, Agent, or Firm*—Madson & Metcalf

[57] ABSTRACT

This invention relates to a detonator firing circuit comprising a control unit and a plurality of detonator circuits. The detonator circuits are arranged to simultaneously receive a "fire" signal and the fire signal initiates all the delay arrangements to allow different groups of detonators to detonate at different times in accordance with a predetermined firing program. In the present invention each detonator circuit has a code individual thereto and the control unit can control and transmit information to every detonator circuit, including the delay to be imparted to the detonator circuit. The identification code for each detonator circuit is preferably one of a large number of identification codes so that the likelihood of the two detonator circuits having the same identification code and having the same firing circuit is extremely small.

15 Claims, 1 Drawing Sheet

DETONATOR CIRCUIT

Figure 1:
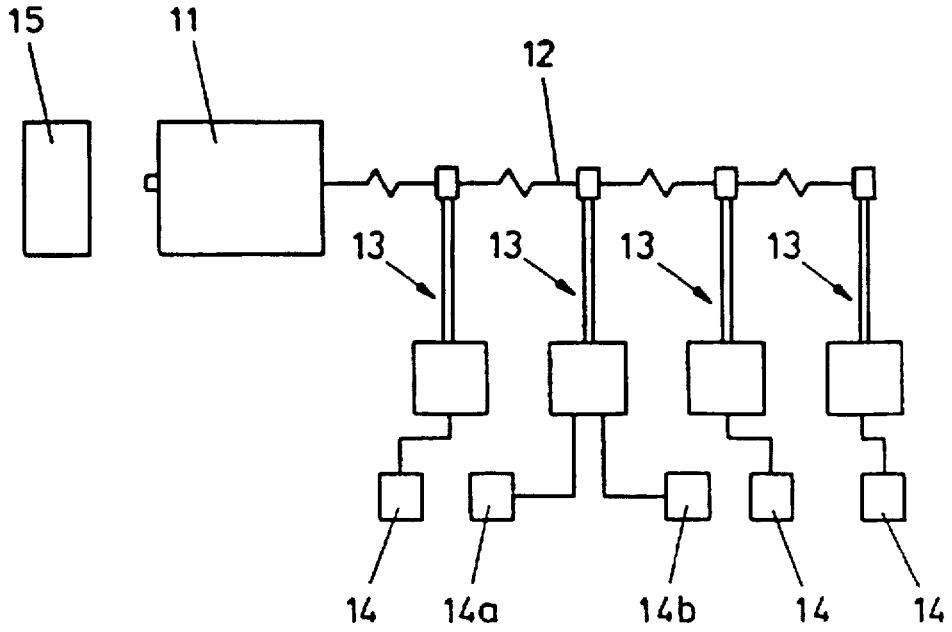

This invention relates to detonation means and has particular application to so-called "multi-shock" blasting wherein a plurality of detonators are detonated in accordance with a desired programme.

In multi-shock blasting up to 250, and often more, detonators are arranged for detonation by a firing signal from a control unit and, for reasons well known in the art, it is the practise to arrange the detonators in separate groups, each group having its detonators spread over the blasting site, and to fire all the detonators in each separate group simultaneously with a time delay between the groups of detonators.

In one conventional method for effecting electrical detonation of a plurality of detonators in a multi-shock blasting arrangement each detonator, or each separate group of detonators, is provided with a delay element, which may be pyrotechnic or electrical, and on receipt of a firing signal from the control unit all the delay elements are initiated and, as the delay element for each detonator or group of detonators runs its course, the detonator(s) associated with that delay element are detonated. As stated above it is usual in multi-shot firing arrangements for different detonators to have different time delay element, so that the pattern of explosives follows the desired pattern but this usually means that the person setting the detonators in position on the blasting site must carry a number of different detonators, with different delay devices, and the different delay detonators must be kept separate from all other detonators, which raises problems on the site in the storage of a multiplicity of different time delay detonators.

Further, the person setting the detonator must be extremely careful that they do not include a detonator with an incorrect time delay in one of the groups of detonators as this could lead to the group not detonating simultaneously, which could lead to serious problems in the desired effect of the detonation.

The problem of marking detonators, has in the past, been limited to marking all the detonators in a firing system, that is to say in systems which rarely exceed 500 detonators. With such a system all the detonators not used in the system must be destroyed, or rearranged for use in a subsequent system.

U.S. Pat. No. 4,674,047 discloses a detonation system in which a number of electrical detonators can be programmed with a unique identification number and delay time by means of a user operable firing console. A command from the firing console includes a unit identification code which is used to address or designate a specific integrated delay detonator.

U.S. Pat. No. 5,295,438 discloses apparatus for timing and initiating a multi-shot blast comprising a programming tool for individually programming a plurality of electronic detonator arrangements with delay time data in which data is loaded from a master computer into a transportable programming tool and is subsequently loaded from the programming tool into each detonator arrangement in turn.

The present invention seeks to provide a firing circuit wherein each detonator circuit has a coding individual thereto and wherein the chances of two detonator circuits in the firing circuit having the same coding are remote if not totally avoided.

According to the present invention there is provided a detonator firing circuit comprising a control unit and a plurality of detonator circuits, each including at least one detonator, linked to said control unit to receive signals therefrom, wherein each detonator circuit has a code individual thereto and positively identifying that detonator circuit, the identification code is one of a substantial multiplicity of codes in a set, and the control unit can communicate information to a particular detonator circuit by identifying the detonator circuit with the identification code individual to that detonator circuit, characterised in that the identification code of each detonator circuit is supplied to said control unit via a portable device upon which the delay for each detonator circuit can be set prior the control unit communicating information to a particular detonator circuit.

Preferably, the term "substantial multiplicity of codes" when used in the present application is intended to cover in excess of 1,000 different detonator identification codes, more preferably in excess of 100,000 identification codes and most preferably in excess of 1,000,000 identification codes.

Preferably, each detonator circuit has only one detonator and the identification code is applied to the detonator.

In an alternative embodiment at least one of the detonator circuits includes more than one detonator and the identification code is applied to the detonator circuits.

In one embodiment, the firing circuit is characterised in that the identification code is marked electronically on a device attached to the detonator circuit.

Preferably, the firing circuit is characterised in that the identification code is applied to a tag attached to the detonator circuit.

In a preferred embodiment, the detonator circuit identification code is read manually and entered into, or onto, the portable device from which said identification code is transferable to the control unit.

In another embodiment the tag is electronically readable by the portable device.

In a preferred embodiment the portable device is arranged to transmit information concerning the detonator circuit identification code electronically to said control circuit.

Preferably, information transmitted from the said portable device to said control unit is stored electronically in the control unit.

In a preferred embodiment the firing circuit is characterised in that the portable device is arranged to receive and store a detonator circuit identification code and additional information relating to that detonator circuit and comprising, information regarding the location of the identified detonator circuit in the multi-shock blasting arrangement and the delay after which, following a firing signal, the detonator(s) forming part of the detonation circuit is or are to detonate.

Preferably the identification tags are marked with a bar code, which can be read by the portable device.

In another embodiment the tags are marked with a form of binary code which can be read by the portable device.

In a preferred embodiment the detonator circuits are arranged to receive two types of signals, one type of signal wherein the control unit addresses each detonator circuit by the identification code relevant to that circuit and follows the identification code with signals for receipt only by that detonator circuit, and the second type of signal being a signal which overrides or otherwise by-passes the detonator identification codes to impart a "Fire" or an "Abort" signal to all the detonator circuits.

Figure 2:
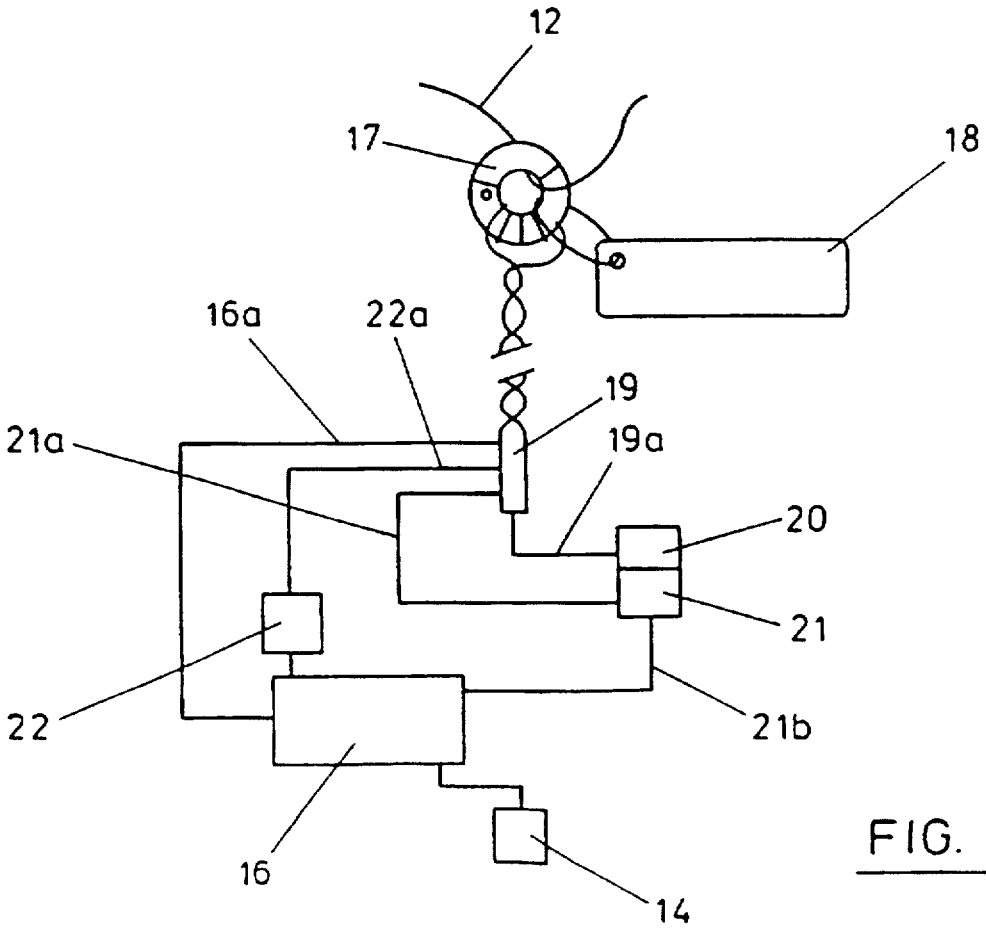

The invention will now be described further by way of example with reference to the accompanying drawings in which, FIG. 1 shows, diagrammatically, a firing circuit in accordance with the present invention and FIG. 2 shows, diagrammatically, one form of detonator circuit in accordance with the invention.

In the embodiment illustrated in FIG. 1 a control unit 11 is connected to a power/signal line 12 which passes in close proximity to each and every detonator circuit 13 in the firing circuit arrangement. Each detonator circuit 13 may include a single detonator 14 or more than one detonator, such as the two detonators 14*a* and 14*b* as shown in FIG. 1, and as the two detonators 14*a* and 14*b* share the same detonator circuit 13 they share the same identification code and thus will both respond simultaneously.

The control unit 11 is adapted to be connected to a portable device 15 in, or on, which is stored information relating to the detonator circuits 13 and the portable device 15 is arranged to be plugged into the control unit and to transmit all the information stored thereon to the control unit 11, which includes an information memory for receiving and storing the information received from the portable unit 15.

The control unit 11 is arranged to transmit two types of signals on the line 12, and which signals may be distinguished by, for example, being of different ranges of frequency. One such type of signal, hereinafter referred to as "signal type 1", is a signal being information to be received by an individual detonator circuit 13 and the other type of signal, hereinafter referred to as "signal type 2", being capable of by-passing the identification codes of the individual detonator circuits 13 so as to be received simultaneously by all of said circuits 13.

The individual detonator circuits 13 each include a capacitor device 16, and all the capacitors 16 are charged and maintained charged by via lines 16*a* by type 2 signals received via the line 12.

For convenience, the connection of each detonator circuit 13 to the line 12 is shown as being via an annular snap-on induction device 17, as shown in FIG. 2. The use of snap-on induction devices 17 is well known in the art for supporting a detonator circuit physically and in electrical contact with the line 12 and no further description is necessary thereof As will be seen from FIG. 2, each detonator circuit 13 includes a detonator circuit identification tag 18, which includes a code individual to the detonator circuit 13 and the identification code is readable by the portable device 15.

The identification code applied to each detonator circuit is one of a "substantial multiplicity of codes" and may be based on a bar code or binary code arrangement whereupon the total number of variants in the code may exceed a million, whereupon the chances of two detonator circuits having the same identification code appearing in a firing circuit is so remote as to be ignored.

The code for each detonator circuit 13, whilst readable from the tag, is also stored on an electronic memory device 19 forming part of each detonator circuit 13. The device 19 is arranged to block all signals type 1 to the detonator circuit 13 other than signals preceded by the identification code of that circuit 13, and which acceptable signals are allowed to pass through the device 19.

Identification signals passing through the device 19 are transmitted via a line 19*a* to a memory device 20, where such information is stored and, when a type 2 "fire" signal is received via line 12, the fire signal is transmitted via a line 21*a* to a timer device 21, the timer device 21 is set to run for the delay period held in the memory device 20 of the delay circuit and, when the timer 21 has run for the set timing, a signal is extended to the capacitor 16 of the relevant detonator circuit, via a line 21*b*, to cause said capacitor 16 to discharge and thereby cause the detonator 14, or detonators 14*a* and 14*b*, to detonate.

The circuit also includes a line 22*a* arranged to receive and transmit a type 2 "abort" signal, which is extended to an abort device 22 and on receipt of a type 2 signal on line 22*a* the device 22 actuates to discharge all the capacitors 16 in all the detonator control circuits 13, whereupon the detonators 14 in all the detonator circuits 13 are in a condition where they cannot detonate.

To use the above arrangement in practise, in a multi-shock blasting operation, the bore holes are drilled in accordance with a predetermined pattern, and said bore holes are charges with secondary explosives, the line 12 is laid out, all the detonator circuits 13 are attached to the line 12 and the detonator, or detonators, 14, all of which at this time have the same delay, are each inserted into the respective secondary explosive, and a person setting up the explosives circuitry will have a plan showing the lay out for the mult-ishock explosives and a time delay to be imparted to each detonator circuit 13. The person setting up the explosives circuitry will have a portable device 15 and will visit each bore hole marked on the plan and at each bore hole will read the tag 18 using the device 15, which will read the identification code for that bore hole and store that identification code in it's memory. The person setting up the firing circuit will then enter onto, or into, the portable device 12 the delay to be imparted to the explosive mass in that bore hole following receipt of a "fire" signal.

With all the identification codes for all the bore holes entered in or on the device 15, together with the delay to be imposed before detonation of each bore hole, the person will plug the device 15 into the device 11 and all the information stored in, or on, the device 15 will be transferred to the control device 11.

The device 11, will, when actuated, transmit all the information contained thereon via the line 12 to all the detonator circuits 13 and, as each detonator circuit 13 is addressed by its individual identification code the device 19 allows the succeeding delay period information to pass through the device and to be entered and recorded on the memory device 20.

Before, or after, the control device 11 has communicated the delays to all the detonator circuits 13, a type 2 signal applied to the line 12 will cause all the capacitors 16 in the circuits to become charged.

With the capacitors 16 fully charged the firing circuit is ready for detonation and the person controlling the firing circuit will cause a type 2 "fire" command to be transmitted via the line 12 to all the detonator circuits 13 whereupon, on receipt of the "fire" signal, all the timer devices 21 are initiated and each timer device 21 will run for the period set in the memory device 20 and, after the preset period has expired, a signal will be sent via line 21*b* to cause the capacitor 16 associated with the respective circuit 13 to discharge to cause the detonator 14 to detonate. In the event that any fault should occur prior to transmission of the type 2 "fire" signal the person controlling the operation can apply a type 2 abort signal to the line 12 which will be transmitted by the line 22*a* of each of the circuits 13 to cause the devices 22 to effect a rapid discharge of the capacitors 16, thus to prevent the detonators 14 from detonating.

Whilst in the embodiment illustrated in FIG. 2 a single capacitor 16 is shown to power a singe detonator 14 it is a common practise to use more than one detonator in each bore hole and, conveniently, to avoid duplication of elements of the detonator circuits 13, a single capacitor 16, may be arranged, on discharge, to fire two detonators, such as 14*a* and 14*b* simultaneously to ensure detonation of the secondary explosive.

Whilst the present invention has been described by way of example the invention is not restricted thereto and many modifications and variations will be apparent to persons skilled in the art.

I claim:

1. A detonator firing circuit comprising:

a control unit (11) and a plurality of detonator circuits (13), each unit including at least one detonator, linked to said control unit to receive signals therefrom, wherein each detonator circuit (13) has a code individual thereto and positively identifying that detonator circuit, the identification code is one of a substantial multiplicity of codes in a set, and the control unit (11) can communicate information to a particular detonator circuit (13) by identifying the detonator circuit (13) with the identification code individual to that detonator circuit (13), characterised in that the identification code of each detonator circuit (13) and a delay for each detonator is supplied to said control unit (11) via coupling of a portable device (15) to the control unit prior to the control unit communicating information to a particular detonator circuit.

2. A detonator firing circuit as claimed in claim 1, characterised in that each detonator circuit (13) has only one detonator (14) and the identification code is applied to the detonator (14).

3. A detonator firing circuit as claimed in claim 1 characterised in that at least one of the detonator circuits (13) includes more than one detonator (14*a*, 14*b*) and the identification code is applied to the detonator circuits (13).

4. A detonator firing circuit according to claim 1, characterised in that the multiplicity of codes is in excess of 1,000.

5. A detonator firing circuit as claimed in claim 1, in which the multiplicity of codes is in excess of 100,000.

6. A detonator firing circuit as claimed in claim 1, in which the multiplicity of codes is in excess of 1,000,000.

7. A detonator firing circuit according to claim 1, characterised in that the identification code is marked electronically on a device (18) attached to the detonator circuit (13).

8. A detonator firing circuit according to claim 7, characterised in that the identification code is applied to a tag (18) attached to the detonator circuit (13).

9. A detonator firing circuit according to claim 1, characterised in that the detonator circuit (13) identification code is read and entered into, or onto, the portable device (15) from which said identification code is transferable to the control unit (11).

10. A detonator firing circuit according to claim 8, characterised in that the tag (18) is electronically readable by the portable device.

11. A detonator firing circuit according to claim 1, characterised in that information transmitted from the portable device (15) to said control unit (11) is stored electronically in the control unit (11).

12. A detonator firing circuit according to claim 3, characterised in that the portable device (15) is arranged to receive and store a detonator circuit identification code and additional information relating to that detonator circuit (13), the firing circuit comprising information regarding the location of the identified detonator circuit (13) in a multi-shock blasting arrangement and the delay after which, following a firing signal, the detonators (14, 14*a* and 14*b*) forming part of the detonation circuit (13) is or are to detonate.

13. A detonator firing circuit according to claim 7, characterised in that identification tags (18) are marked with a bar code, which can be read by the portable device (15).

14. A detonator firing circuit according to claim 7, characterised in that the tags (18) are marked with a form of binary code which can be read by the portable device (15).

15. A detonator firing circuit according to claim 1, characterised in that the detonator circuits (13) are arranged to receive two types of signals, one type of signal wherein the control unit (11) addresses each detonator circuit (13) by the identification code relevant to that circuit (13) and follows the identification code with signals for receipt only by that detonator circuit (13), and the second typo of signal being a signal which overrides or otherwise by-passes the detonator identification codes to impart a "Fire" or an "Abort" signal to all the detonator circuits (14, 14*a* and 14*b*).

* * * * *

UNITED STATES PATENT AND TRADEMARK OFFICE

CERTIFICATE OF CORRECTION

PATENT NO. : 5,894,103
DATED : April 13, 1999
INVENTOR(S) : Peter Christian Shann It is certified that error appears in the above-identified patent and that said Letters Patent is hereby corrected as shown below:

Column 3,
Line 38, after "thereof", please insert therefor -- . --.

Column 6,
Line 37, please delete "typo" and insert therefore -- type --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*